US005409021A

United States Patent [19]

Safaev et al.

[11] Patent Number: 5,409,021

[45] Date of Patent: Apr. 25, 1995

[54] CIGARETTE FILTER

[76] Inventors: Radzhab D. Safaev, ulitsa Marshala Zakharova, 10, korpus 2, kv. 230; David G. Zaridze, Goncharny proezd, 8/40, kv. 33; Leonid Y. Sinelnikov, ploschad Pobedy, 1, korpus B, kv. 220, all of Moscow, Russian Federation

[21] Appl. No.: 51,153

[22] Filed: Apr. 22, 1993

[30] Foreign Application Priority Data

Apr. 22, 1992 [RU] Russian Federation ..... 5039476

[51] Int. Cl.[6] ..... A24D 3/00

[52] U.S. Cl. ..... 131/344; 131/331

[58] Field of Search ..... 131/331, 335, 344

[56] References Cited

U.S. PATENT DOCUMENTS 5,076,297 12/1991 Farrier et al. ..... 131/369
5,083,579 1/1992 Vanin ..... 131/334

FOREIGN PATENT DOCUMENTS 0493026 1/1992 European Pat. Off. .
1094642 12/1967 United Kingdom ..... 131/344

OTHER PUBLICATIONS

Safaev, R. D. et al., "The Effect of The Cigarette Filter . . . " Experimental Oncology N1, vol. 14, (1992) pp. 24–27 & English translation.

Safaev, R. D. et al., "Assessement of Some Substances . . . " Experimental Oncology N3, vol. 14, (1992) pp. 25–29 & English translation.

World Health Orgonization, International Agency for Rearch on Cancer "Tobacco: A Major International Health Hazard", IARC Scientific Publications, Zigon, 1986, No. 74, pp. 273–275.

Pearl, I. A. "The Chemical Structure . . . " The Chemistry of Lignin, Marcel Dekker, Inc. (1967) N.Y. pp. 112–135.

Hoffman, D. et al. "II.2.6. Volatile Nitrosamines . . . ", Environmental Carcinogens.

Selected Methods of Analysis vol. 6, (1983) Lyon, pp. 69–101.

Jenkins, R. A. "Occurrence of Selected . . . "in: Environmental Carcinogens Selected Methods of Analysis vol. 8, Lyon, (1986) pp. 129–138.

Brunnemann, K. D. et al. "Chemical Studies on Tobacco Smoke", Journal of Chromatographic Science, vol. 12, (1974) pp. 70–75.

*Primary Examiner*—Jennifer Bahr
*Attorney, Agent, or Firm*—Ladas & Parry

[57] ABSTRACT

A cigarette filter, including at least two parts, sucessively located in the direction of tobacco smoke flow and joined by a wrapping means, one part of the filter, positioned at the side of the smoker, being made of acetate, cellulose, acetatecellulose fiber, while the other part, positioned at the side of the tobacco, is filled with an adsorbing substance, which substance is lignin.

3 Claims, 2 Drawing Sheets

CIGARETTE FILTER

FIELD OF THE INVENTION

The present invention relates to the field of purifying tobacco smoke of carcinogenic and toxic substances and to a cigarette filter. The filter can be used by the tobacco industry in the manufacture of filter cigarettes.

BACKGROUND OF THE INVENTION

Filters comprising a base made of acetate-cellulose fibers in combination with charcoal are known in the art. The charcoal can be contained in the base as mechanical inclusions, may form a coating on the base or simply be in contact with it. A drawback of these filters is that they do not completely eliminate the harmful effect of a number of the carcinogenic and toxic components of tobacco smoke.

In view of this, effective filtration means are needed which remove as much as possible a large amount of the harmful components of tobacco smoke, but permit its organoleptic characteristics to be preserved.

Also known is another cigarette filter made from hydroxyapatite in combination with acetate fibers or activated charcoal. The hydroxyapatite may be represented by the formula $$3[Ca_3(PO_4)]M(OH)_2,$$

where M is a cation of calcium, strontium or lead.

Generally, hydroxyapatites are used in which the M-cation is calcium, since this material is not toxic, and is highly effective. The hydroxyapatite is a material having a particle size of from 2 to 5 μm and is used in the filter in an amount of from 0.1 to 20% of the tobacco weight in the cigarette. This filter can be made in the form of a tablet, sleeve, mouthpiece, etc. The filter ensures an improved absorption of harmful substances, such as nicotine, tar, carbon monoxide, from the tobacco smoke. However, it does not facilitate the absorption of carcinogenic and toxic substances, such as the polycyclic aromatic hydrocarbons benzo(a)pyrene, benzo(g,h,c,)perylene, dibenzo(a,h)anthracene, dibenzo(a,c)anthracene and volatile nitrosoamines (N'-nitrosodiethylamine, N'-nitrosopyrrolidine), from tobacco smoke.

Various cigarette filters are known which decrease the toxic effect of tobacco smoke. These consist of a base made of acetate, cellulose or acetate-cellulose fibers with substances applied unto the base which have adsorption properties or are impregnated with these substances.

Activated charcoal, inorganic and organic slats of mercaptoalkanesulfonic acids (cysteine, acethylcysteine and phthalocyanins) are used as the adsorbing agents.

A drawback of these filters is that the range of substances absorbed by them is restricted. The filters themselves can degrade on heating, which is accompanied by the formation of toxic compounds. Thus, for example, the utilization of phthalocyanine as a sorbent may result in the formation of the following products of decomposition: organic cyanides, ammonia, benzene derivatives, etc.

A filter is also known (see U.S. Pat. No. 5,083,579, of Jan. 28, 1992) comprising a base made of acetate, cellulose or acetate-cellulose fibers, and an absorbing substance which is a complex compound of bivalent iron and a ligand, which is a thiol containing low-molecular weight compound. In that compound the ratio of the iron ions to the number of ligand molecules is not greater than 1:2, while the amount of the absorbing substance is from 3 to 13% of the total weight of the filter.

In this filter the sources of bivalent iron were usually the salts of iron for example, $FeSO_4$, $FeCl_2$and, $Fe(NO_3)_2$. Monothiol-containing compounds (sodium thiol-sulphate, cysteine reduced gluthatione, etc.) and dithiol-containing organic compounds (diethyldithiocarbamate, dimethyldithiocarbamate, sodium ethylxanthate, etc.), were used as the thiol-containing low-molecular compounds.

The described filter makes it possible to efficiently clean the tobacco smoke of nitrogen oxide, but it does not, just like all the filters described, reduce the content in the tobacco smoke of such carcinogenic and toxic substances as polycyclic aromatic hydrocarbons (benzo(a) pyrene, benzo(g,h,i) perylene, dibenzo(a,h) anthracene, dibenzo(a,c) anthracene, volatile nitrosoamines (N'-nitrosodiethylamine, N'-nitrosopyrrolidine) as well as such metals as magnesium, calcium, strontium, copper, lead, arsenic, vanadium, chromium, manganese, iron, cobalt and nickel.

An acetate-cellulose filter is known comprising 10% triacetine as the adsorbing substance (see Williamson J. T. et al "The modification of cigarette smoke by filter tips", Betr. Tabakforseh., 1965, Bd.2, p. 233–242).

This filter selectively absorbs carcinogenic N-nitrosocompounds:

N-nitrosodiethylamine up to 75%, N-nitrosodiethylamine up to 50%,

N-nitrosopyrrolidine up to 74%, tar up to 35%, nicotine up to 28%.

A drawback of this filter is that in practice it does not absorb benzo(a) pyrene and carcinogenic metals.

The filter most similar to the present invention is the cigarette filter comprising a base made of an acetate, cellulose or acetate-cellulose fiber, impregnated with an adsorbing substance which is a solution of an organosilicon monomer N, N'-bis(3-triethoxysilylpropyl)-thiocarbamide $(C_2H_5O)_3Si(CH_2)_3NH - C(S)-NH(CH_2)_3Si(OC_2H_5)_3$, the amount of which is from 6 to 15.3% by weight of the weight of the base (see the publication of the application for European patent No. 0 493 026 of Jul. 1, 1992).

Standard cigarette filters are impregnated with a 4–10% solution of the mononer in a solvent, preferably in hexane, and convectively dried at 60° in a thermostat.

This cigarette filter makes it possible to catch the carcinogenic and toxic substances, in particular, carcinogenic metals, N-nitrosocompounds and benzo(a)pyrene, better than known cigarette filters.

However, a drawback of this cigarette filter is that in respect of the absorption of carbon monoxide, nicotine and tar, it does not differ from known cigarette filters, and furthermore, it does not completely catch the N-nitrosocompounds.

The known cigarette filters described above do not as a whole reduce the amount of carcinogenic compounds in the mainstream of tobacco smoke by more than 50%, and each of the known filters is only capable of reducing the amount of a certain class of chemical compounds having carcinogenic and toxic properties. Therefore, a problem remaining in the existing filters is to reduce the level of the carcinogenic benzo(a)pyrene, carcinogenic metals, volatile N-nitrosocompounds, tobacco-specific N-nitrosocompounds, and also carbon monoxide, tar and nicotine, which would make it possible to reduce the risk of falling ill with malignant growths and other illnesses related to cigarette smoking.

The object of the present invention is to improve the amount of carbon monoxide, tar, nicotine, carcinogenic benzo(a)pyrene, carcinogenic metals, volatile nitrosocompounds and tobacco-specific N-nitrosocompounds removed from tobacco smoke.

DISCLOSURE OF THE INVENTION

This object is achieved in that in a filter comprising at least two parts, successively located in the direction of tobacco smoke flow and joined by a wrapping means, the first part is positioned at the side of the smoker's face and is made of acetate, cellulose, or acetate-cellulose fiber, the second part is positioned at the side of the tobacco and is filled with an adsorbing substance which, in accordance with the invention, is a lignin.

In another embodiment, the filter contains a third part positioned between the said tobacco and the said second part and made of acetate, cellulose or acetate-cellulose fiber.

This filter is easy to manufacture.

It is also preferable that the length of the second part, filled with lignin, be from 1.5 to 2.5 mm.

DETAILED DESCRIPTION OF THE INVENTION

The invention is hereinafter explained by a description of specific examples of its realization with reference to the figures in which.

Figure 1:
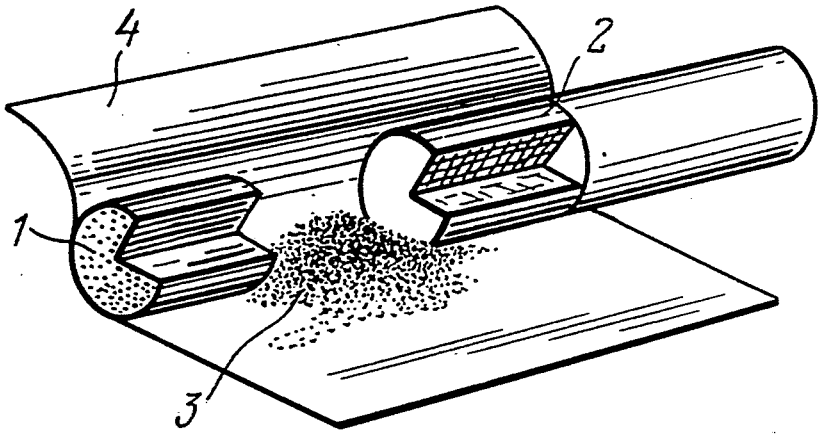
FIG. 1 shows a perspective view of the filter according to the invention.

The cigarette filter comprises three parts 1, 2, 3, successively located in the direction of tobacco smoke flow (FIG. 1). Part 1, positioned at the side of the smoker, is made of acetate fiber, Part 2, positioned at the side of the tobacco, is made of cellulose fiber. Part 3, positioned between parts 1 and 2, is filled with an adsorbing substance which is lignin. All three parts 1, 2, 3 are wrapped up in paper 4 joining them into a single filter.

The amount of lignin necessary to fill part 3 is determined by the equation:

$$G = \frac{g(\pi D^2)}{4L}$$

where

G is the weight of the lignin, g;

$\pi = 3.14$;

g is the specific weight of the lignin, mg/mm$^3$;

D is the diameter of the cigarette filter, mm;

L is the length of part 3 of the filter, filled with lignin, which length is from 1.5 to 2.5 mm.

Figure 2:
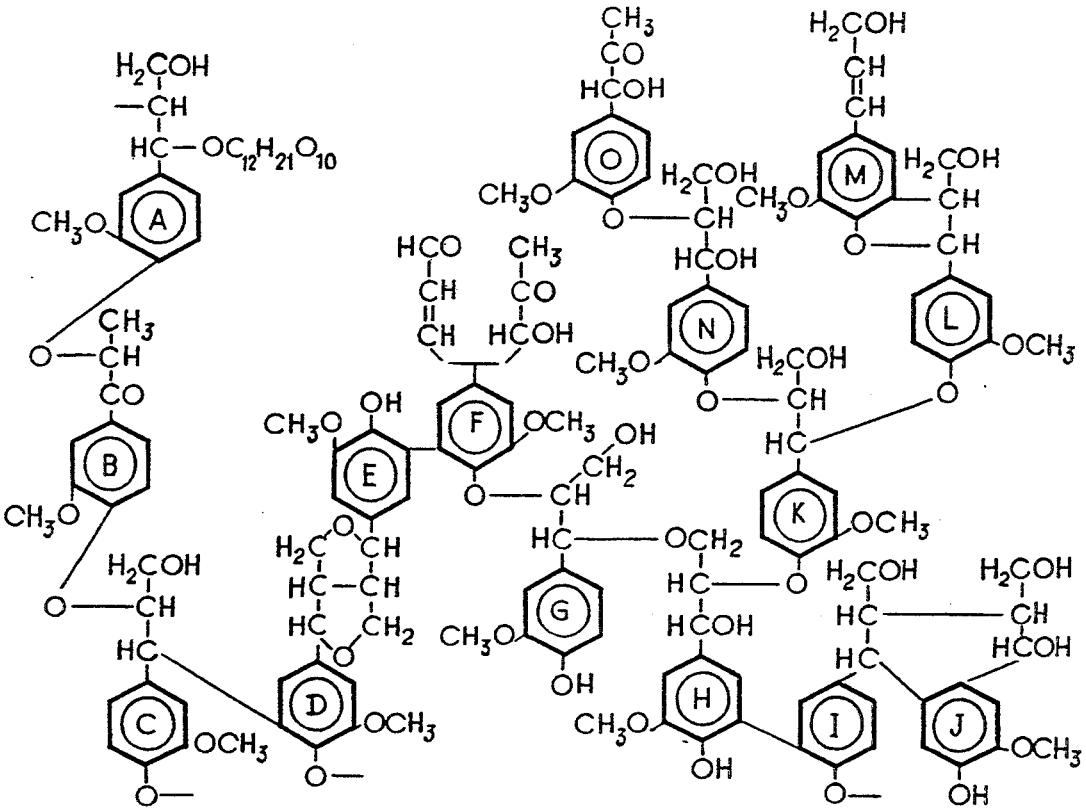
FIG. 2 shows one of the structural formulas of a lignin used as the adsorbing substance.

What is meant by lignin, one of the main structural components of plants, especially wood, is at the present time the natural polymeric products formed as a result of the dehydrogenation of three basic predecessors: coniferyl, sinapic and courmaric alcohol. One of the structural formulas of lignin is presented in FIG. 2 (see, for example, I. A. Pearl "The Chemistry of Lignin", Marcel Depper, N.Y., 1967).

Figure 3:
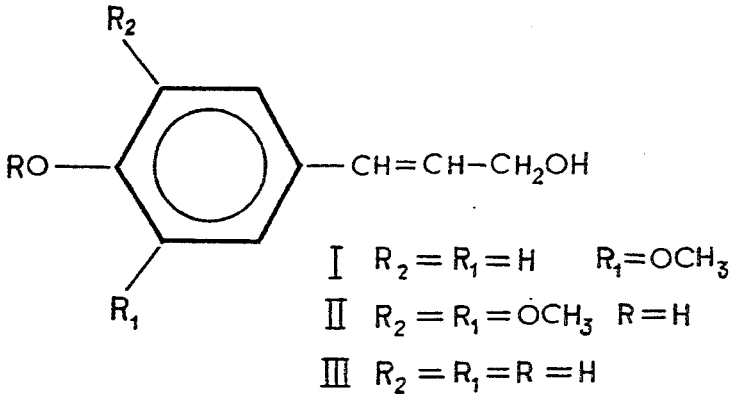
FIG. 3 shows the structural formula of the predecessors of the lignin.

Ferulic and caffeine acids are structural elements of a lignin. The high activity of those compounds in respect of the bonding of, for example, nitrate ions makes it possible to assume that the lignin may have the capability to inhibit the nitrosation reaction and other elements of the structure may also be highly active in respect of a different class of chemical compounds which are present in the tobacco smoke. The predecessors of the lignins: coniferyl, sinapic and coumaric alcohol, are shown in FIG. 3 as I, II, III, respectively.

The structure of a lignin obtained by mechanical grinding does not in practice comprise changed elements and most closely corresponds to the lignin in its natural state (see, for example, the book by Sarkanen K.V., Ludvig K.H. "Lignins", moscow, 1975, p.632). A specially treated lignin, known as polyphepan, is used in medicine as an enterosorbent in the case of infectious diseases.

The object of the present invention was achieved by using lignin in the cigarette filter as the adsorbing substance, which substance is not being used at present as an adsorbent in cigarette filters.

The high adsorbing and selective capability of lignin in respect of the chemical compounds under consideration is a result of the following features of its chemical and physical structure and also the mechanism itself of filtering the tobacco smoke.

It is usually assumed that two main mechanisms participate during filtration of the smoke: diffusion and the direct catching of smoke particles, the size of which is within the range of from 0.1 to 1.0 $\mu$m.

Carbon monoxide, carcinogenic N-nitrosocompounds are found in the smoke in a gaseous phase state and therefore interact with the structural elements of the lignin, the ferulic and caffeine acids (see FIG. 3), which have a high capability for inhibiting the formation and reaction of nitrosation, this being evident from the Tables 3 and 4 provided herebelow.

On the other hand, since it has a large adsorbing surface, the lignin efficiently adsorb ions of the metals, which are deposited on the smoke particles and adsorbed by directly catching the particles (see Table 5). The length of part 3 of the filter, which is filled with lignin, was chosen on the basis of the obtained data to be from 1.5 mm to 2.5 mm, this depending, for example, on the quality of the tobacco used in the cigarette.

Since the lignin is a solid sorbent, it, naturally, causes the pressure on the filter to drop, which in turn additionally increases the removal of tar from the mainstream smoke (see Table 2).

The present cigarette filter can be made by all known manufacturing methods which are used in the production of combined cigarette filters with solid sorbent substances.

As an example, consideration will be given to three combined cigarette filters, each of which is 18 mm long and consists of the aforementioned parts 1, 2 and 3. The length of part 3, filled with lignin was 1 mm, 2 mm, and 3 mm, while the weight of the lignin was 22 mg, 44 mg and 66 mg, which correspond to volumes of the lignin filling equal to, respectively:

$V_1 = \pi D^2/4$ (filter "A"), $V_2 = \pi D^2/2$ (filter "B") and $V_3 = 3\pi D^2/4$ (filter "C"), where D is the diameter of a standard cigarette filter equal to 9 mm, V is the volume of part 3 filled with lignin, $mm^3$.

Cigarettes with the filters described above were subjected to tests in the following manner.

The cigarettes for the experiments were selected from one party. The preparation of the cigarettes for analysis for nicotine, tar and carbon monoxide was conducted in accordance with the methods described in:

"International Standards Organization International Standard ISO 3402. Tobacco and tobacco products—Atmospheres for conditioning and testing, Geneva, 1987" and "International Standards Organization International Standard ISO 3308. Cigarettes-Routine analytical cigarette—smoking machine. Definitions and standard conditions, Geneva, 1986, P.6".

The cigarettes were smoked in accordance with the standards under the following conditions: prior to analysis all the cigarettes were conditioned for 48 hours at a temperature of 22° C. and relative humidity of 60%. They were smoked on a 20-position automatic rotary smoking machine RM20/CS made by the "Borgwaldt" firm (Germany), with the volume of the puff equal to 35 ml, the duration of the puff—2 sec, frequency—one puff per minute on 1 Cambridge filter.

Standard methods of analysis were used to determine the amounts of tar, nicotine and carbon monoxide, which methods are provided in the following publications:

Brunnemann K.D. and D. Hoffman: "Chemical studies on tobacco smoke XXIV. A quantitative method for carbon monoxide and carbon dioxide in cigarette and cigar smoke", J. of Chromat. Sci., vol. 12, 1974, pp. 7075;

Pillsburi H.C., Bright C.C., O'Connor K.J. and Irish F.W.: "Tar and nicotine in cigarette smoke", J. Assoc. Off. Anal. Chem., 52, 1969, pp. 458–462;

ISO 10362-1-1--1 "Cigarettes—Determination of water in smoke condensates—Part 1: Gas-chromatographic method";

ISO 10315-1991 "Cigarettes—Determination of nicotine in smoke condensates—Gas-chromatographic method";

ISO 7210-1983 "Smoking machines for tobacco and tobacco products—Non-routine test methods", (Standard ISO 3308, 1986).

The condensate from five cigarettes smoked through the Cambridge filter was used to determine the amount of benzo(a)pyrene. The condensate was extracted with benzene by ultrasound (Ultrasonic cleaner, B-12, 80, 80 watts, Brenson, USA), for 30 minutes, twice. The extraction obtained was evaporated on a rotor evaporator to 5 ml at 35° C., then 1 ml was used for thin-layer chromatography with a non-attached layer of aluminum oxide (second degree by Brokman) in a hexane benzene system. After the chromatographs were developed the glow zone of benzo(a)pyrene was discerned under an ultraviolet lamp and the benzo(a)pyrene determined in the obtained fraction on a Hitachi-850 spectrofluorimeter (Japan) at the temperature of liquid nitrogen (see Safaev R.D., Belitsky G.A., Litcheva T.A. et al "The effect of the cigarette filter modification on the chemical carcinogens content in the cigarette smoke condensate and its genotoxicity", Eksper. Onkologiya, v. 14, 1, 1992, pp. 24–27, and Safaev R.D., Zaridze D.G., Belitsky G.A. "Assessment of some substances in the tobacco and mainstream smoke of USSR cigarettes: polynuclear aromatic hydrocarbons, metals and pesticides", Eksper. Onkologiya, v. 14, 3, 1992, pp. 25–29).

To determine the amount of carcinogenic volatile N-nitrosocompounds, the smoke from 40 cigarettes was passed through two successively connected fluid traps with a citrate-phosphate buffer, having pH=4.5 and comprising 20 millimoles (mM) of ascorbic acid. The amounts of N-nitrosamines specific for tobacco: N-nitrosoanatabine (NAT), N-nitrosonornicotine (NNN), 4-(methylnitrosamine)-1-(3-pyridyl)-1-butanon (NNK); and volatile N-nitrosamines: N-nitrosodimethylamine (NDMA), N-nitrosodiethylamine (NDEA), N-nitrosopyrrolidine (NPYR), were determined in accordance with the method described in "IARC Scientific Publications. No. 45 . Environmental carcinogens selected methods of analysis, vol. 6. N-Nitrosocompounds". Lyon, 1986, pp. 69–103.

To determine the amount of metals, the smoke from five cigarettes was smoked through a Cambridge filter and extracted using an ultrasound bath. The extract obtained was filtered through a porous ceramic filter-funnel, then washed 2 times with 5 ml of 5-normal (5) nitric acid. The clean and whole extract, including the volume of the washer, was poured into a Kjeldahl flask and evaporated by heating until moist salts appeared. The remainder was diluted to 15 ml with deionized water and the ready solution was analyzed on a plasma emissive JV-48 spectrometer (Jobin-Ivon firm, France) (see the method presented in Jenkins R. "Occurrence of selected metals in cigarette tobaccos and smoke, IARC, Environmental carcinogens selected methods of analysis", IARC, IARC Sci. Publ., 1986, No. 71, v.8, Lyon, pp. 129–138).

The results of the testing of cigarettes with a filter, cigarettes with a control filter and cigarettes with the three aforementioned filters "A", "B" and "C", in respect of the main commercial parameters—tar, nicotine and carbon monoxide, and also in respect of carcinogenic benzo(a)pyrene are provided below.

A filter consisting of two parts was used as the control filter. One part, made of acetate fiber, has a length of 5 mm, while the other part, made of cellulose fiber, has a length of 10 mm. The diameter of the filter is 9 mm.

It is evident from results of the analysis (Table 1) that filter "B" is the most efficient filter both in respect of the capability to absorb tar, nicotine and carbon monoxide, and in respect of the absorption of benzo(a)pyrene. Filter "C" has indistinguishable distinctions as compared with filter "B" and therefore all further evaluations on the efficiency of the filter will be made in respect of variant "B".

TABLE 1

Amount of main compounds being checked in the mainstream smoke in the case of a combined filter containing lignin

| Group | Length of the part of the filter filled with lignin, mm | lignin, mg | nicotine mg/cigarette | tar mg/cagarette | CO % | benzo(a) pyrene ng/cig. |
|---|---|---|---|---|---|---|
| Without filter | — | — | 1.70 | 22.1 | 5.9 | 69.6 |
| Control filter | — | — | 1.27 | 19.2 | 5.7 | 21.7 |

TABLE 1-continued

Amount of main compounds being checked in the mainstream smoke in the case of a combined filter containing lignin

| Group | Length of the part of the filter filled with lignin, mm | lignin, mg | nicotine mg/cigarette | tar mg/cagarette | CO % | benzo(a) pyrene ng/cig. |
|---|---|---|---|---|---|---|
| Filter "A" | 1.0 | 22.0 | 0.68 | 16.3 | 3.34 | 18.9 |
| Filter "B" | 2.0 | 44.0 | 0.40 | 10.2 | 2.35 | 4.80 |
| Filter "C" | 3.0 | 66.0 | 0.68 | 9.8 | 2.34 | 4.24 |

The efficiency of filter "B" in respect of the main compounds being checked in the main stream of the tobacco smoke is presented in Table 2

TABLE 2

Amount of main compounds being checked in the main stream of tobacco smoke using combined filter "B"

| Group | tar mg/cig. | nicotine mg/cig. | CO | benzo(a) pyrene ng/cig. | Coefficient of absorption % tar | nicotine | CO | benzo(a) pyrene |
|---|---|---|---|---|---|---|---|---|
| 1 | 2 | 3 | 4 | 5 | 6 | 7 | 8 | 9 |
| Without filter | 22.1 | 1.7 | 14.2 | 69.6 | — | — | — | — |
| Control filter | 19.2 | 1.27 | 13.6 | 21.7 | 13.1 | 25.3 | 4.23 | 69.00 |
| Filter "B" | 10.2 | 0.4 | 11.2 | 4.8 | 53.8 | 76.5 | 21.11 | 93.10 |

The results of filter tests in respect of the capability to absorb carcinogenic volatile N-nitrosocompounds, N-nitrosamines specific to tabacco and metals are provided in Tables 3, 4 and 5.

The absorbent capability of the filter (%) is calculated as the absolute difference between the value of the data of a cigarette without a filter (WF) and experimental data ("B"), which is then divided by the data on the cigarette without the filter and multiplied by 100% in accordance with the equation:

$$(WF-\text{"B"})/WF\times 100\%$$

It is evident from Tables 3 and 4 that filter "B" has a high absorbent capability for N-nitrosocompounds.

TABLE 3

Amount of main volatile N-nitrosocompounds in the mainstream smoke with the combined filter "B" (ng/cigarette)

| Type of filter | NDMA | NDEA | NRYR | Absorbent factor, % NDMA | NDEA | NRYR |
|---|---|---|---|---|---|---|
| Without filter | 76.30 | 26.90 | 81.03 | — | — | — |
| Control filter | 44.50 | 21.10 | 42.20 | 41.70 | 21.60 | 47.90 |
| Filter "B" | 27.60 | — | 18.90 | 63.80 | 100.00 | 76.70 |

TABLE 4

Amount of to tobacco-specific N-nitrosocompounds in the mainstream smoke with the combined filter "B" (ng/cigarette)

| Type of filter | NAT | NNN | NNK | Absorption factor, % NAT | NNN | NNK |
|---|---|---|---|---|---|---|
| Without filter | 154.54 | 354.37 | 39.26 | — | — | — |
| Control filter | 144.63 | 294.28 | 30.30 | 12.60 | 17.00 | 22.80 |
| Filter "B" | 96.90 | 195.60 | 21.14 | 41.50 | 44.80 | 46.20 |

It is evident from Table 5 that filter "B" efficiently absorb carcinogenic metals: Ni-by 100%, Cd-by 94%, Cr-by 95.8%, As by 95.7%.

TABLE 5

Amount of metals in the mainstream smoke with combined filter "B" (micrograms per cigarette)

| Metal | Type of filter: Control filter | Filter "B" | Absorption factor, % Filter "B" |
|---|---|---|---|
| Ca | 31.36 | 11.91 | 62.0 |
| Ni | 0.11 | — | 100.0 |
| Cu | 0.17 | 0.04 | 76.5 |
| Sr | 0.18 | 0.12 | 33.3 |
| Cr | 0.01 | 0.01 | 95.8 |
| Cd | 0.001 | 0.003 | 94.0 |
| Co | 0.04 | 0.02 | 83.3 |
| As | 0.07 | 0.03 | 95.7 |
| Pb | 0.09 | 0.05 | 92.4 |

The absorbent capability of the filter (%) in the foregoing tables is calculated in the following manner: the absolute difference between the control and experimental values is divided by the control value and multiplied by 100%.

As compared with known filters, the proposed cigarette filter made of cellulose, acetate-cellulose or acetate fiber with adsorbing lignin, efficiently absorb carbon monoxide, tar, nicotine, benzo(a)pyrene, carcinogenic metals and both classes of N-nitrosocompounds.

Thus, the proposed filter makes it possible to reduce the cancer risk related to cigarette smoking.

A merit of the proposed filter is also that the manufacturing process is relatively simple, since the introduction of the lignin is accomplished by simply filling that part of the filter designed to be filled.

We claim:

1. A cigarette filter comprising: at least two parts successively located:

the first of said parts, positioned at a first side being made of acetate, cellulose, or acetatecellulose fiber;

the second of said parts, consists essentially of lignin; and a wrapping means joining the at least two said parts.

2. A filter according to claim 1, comprising a third part positioned and adjacent said second part with said second part adjacent said first part and said third part made of acetate, cellulose, or acetate-cellulose fiber.

3. A filter according to claim 1, in which the length of the second said part filled with the lignin is from 1.5 to 2.5 mm.

* * * * *